US009775471B1

(12) United States Patent
Weatherly

(10) Patent No.: US 9,775,471 B1
(45) Date of Patent: Oct. 3, 2017

(54) TEMPORARY SHOWER DOOR SYSTEM

(71) Applicant: James Weatherly, Ashton, MD (US)

(72) Inventor: James Weatherly, Ashton, MD (US)

( * ) Notice: Subject to any disclaimer, the term of this patent is extended or adjusted under 35 U.S.C. 154(b) by 191 days.

(21) Appl. No.: 14/738,897

(22) Filed: Jun. 14, 2015

(51) Int. Cl.
*A47K 3/34* (2006.01)
*A47K 3/28* (2006.01)
*E06B 3/46* (2006.01)

(52) U.S. Cl.
CPC ..... *A47K 3/34* (2013.01); *A47K 3/28* (2013.01); *E06B 3/4636* (2013.01)

(58) Field of Classification Search
CPC ..... A47K 2003/307; A47K 2003/305; A47K 3/36; A47K 3/34; A47K 3/30
USPC ..... 49/505, 504, 406, 411, 413; 52/217
See application file for complete search history.

(56) References Cited

U.S. PATENT DOCUMENTS 2,698,677 A * 1/1955 Tadd ..... A47K 3/36 16/242
2,743,795 A 5/1956 Taubman
2,761,533 A 9/1956 Grossman
2,856,040 A 10/1958 Dansereau
2,980,969 A * 4/1961 Tinfow ..... A47K 3/34 49/411
3,359,573 A 12/1967 Casebolt
3,553,891 A * 1/1971 Casebolt ..... A47K 3/36 49/505
4,031,665 A * 6/1977 Abramson ..... E06B 3/12 49/489.1
4,035,957 A 7/1977 Roloff
4,178,718 A 12/1979 Laby
6,701,672 B2 3/2004 Teubert et al.
6,895,714 B2 5/2005 Teubert et al.
2011/0035874 A1 2/2011 St. Jean

* cited by examiner

*Primary Examiner* — Erin Deery
(74) *Attorney, Agent, or Firm* — Garcia-Zamor IP Law; Ruy M. Garcia-Zamor

(57) ABSTRACT

A temporary barrier for enclosing a bathing enclosure such as a bathtub-shower combination or simply a shower enclosure uses a frame that sits atop a front surface of the enclosure such as on the top of the bathtub and abuts each of the opposing outside walls of the enclosure. A pair of sliding shower doors is slidably disposed within the frame, or alternately, a pair of doors is pivotally attached within the frame, or one door pivotally attached with a fixed panel next to the pivoting door. A pair of tensioning mechanisms is attached, one each to each of the horizontal members of the frame, in order to securely wedge the frame between the outside walls.

9 Claims, 6 Drawing Sheets

TEMPORARY SHOWER DOOR SYSTEM

BACKGROUND OF THE INVENTION

1. Field of the Invention

The present invention relates to a system that forms a frame about a bathing enclosure, either a bathtub-shower combination or simply a curtained shower enclosure, in order to provide a temporary (including long term temporary) and removable operable shower door system for the bathing enclosure.

2. Background of the Prior Art

Many bathrooms have a bathtub shower combination enclosure or even a shower enclosure wherein the enclosure is open, that is, lacks a door or other solid enclosure. In order to take a shower and keep the water from spraying all over the bathroom, a shower curtain is hung from a curtain rod installed above the outer edge of the tub and with the shower curtain acting as a soft barricade against the spraying water.

While effective, many users are not particularly fond of shower curtains. As the curtain must hang within the bathtub to be effective, the curtain intrudes on the showering space of the user—which is especially problematic is smaller sized bathtubs. Similarly, a shower curtain gives many users an uneasy enclosed, somewhat claustrophobic feeling, even if the shower curtain is transparent or translucent. A user often bumps the curtain during showering, sometimes to the point of pushing the bottom of the curtain out of the bathtub so as to have to stop and reposition the curtain back into proper place. Shower curtains often billow against the bather and cling to the bather as a natural result of air movement generated by the flowing water and the air conditioning system. Shower curtains are difficult to clean. Shower curtain rings tend to be fragile and often need replacement as does the shower curtain which leads to even more breakage problems with the shower curtain rings. Many users like to see into the main part of the bathroom, especially if another person is present, so that a comfortable conversation may occur. The same is true of shower only enclosures that use a curtain.

To combat the lack of satisfaction with shower curtains, fixed sliding or swinging doors can be installed above the outer edge of the bathtub. Such enclosures do not intrude into the interior space of the shower footprint and do not need to be adjusted if bumped, other than possibly to slightly reclose the door. As these enclosures tend to be transparent, they tend not to give users a feeling of claustrophobia and allow a relatively normal conversation to transpire between a shower user and another person within the bathroom.

While effective, such solid enclosures need to be installed in a fixed manner, typically requiring the drilling of holes into the walls above the bathtub and possibly into the bathtub itself and/or the use of adhesives. If the potential installer is a homeowner, such installation is not problematic from a permission point of view, although many homeowners do not want to use adhesives or permanent fasteners. The main problem with such enclosures is with renters. While a renter may ask a landlord to install such an enclosure into a rental unit, such requests tend to fall on deaf ears. The renter may desire to install the enclosure at his or her own expense, however, many landlords will not permit such installations, and even if a landlord so permits, such installations can be quite costly, often requiring the services of a skilled installer to accomplish. Once installed, such enclosures are considered an improvement to realty and remain with the property after the tenant vacates. As such, installation of such an enclosure by a renter can be quite cost prohibitive.

What is needed is a system that can provide a solid fixed enclosure above a bathtub in a bathtub-shower combination or a shower so as to eliminate the need to use a shower curtain while showering. Such a device must allow installation of the device without the need to make any permanent alterations to the bathtub or to the walls surrounding the bathtub or the use of strong adhesives so as to dispense with the need to seek landlord permission prior to installation. Such a device must be installable and removable quickly and easily without the need for a skilled installer.

SUMMARY OF THE INVENTION

The temporary shower door system of the present invention addresses the aforementioned needs in the art. The temporary shower door system provides a fixed sliding door system or alternately a swinging door system for a bathtub-shower combination enclosure in order to act as a water barrier during showering so as to eliminate the need for a shower curtain. The temporary shower door system can use transparent doors so as to give the user a feeling of openness so as to reduce the potential for a feeling of claustrophobia, although translucent, opaque, etched, or other types of decorative doors can also be used. Installation of the temporary shower door system within the bathtub-shower combination enclosure does not require any alterations to the bathtub or to the walls of the enclosure so as to dispense with the need for permission prior to installation and many landlords may want to install the system without prompting as a relatively easy way to enhance the rental property. Installation of the temporary shower door system is quick and easy, requiring no special tools or skilled technician. The temporary shower door system is of relatively simple design and construction, being produced using standard manufacturing techniques, so as to make the device relatively inexpensive to produce so as to make the temporary shower door system economically attractive to potential consumers of the device.

The temporary shower door system of the present invention is comprised of a bottom rail that has a first end and a second end as well as a first channel and a parallel second channel. A lower tensioning mechanism is disposed within the bottom rail proximate the first end. A top rail has a third end and a fourth end as well as a first roller track and a parallel second roller track. An upper tensioning mechanism is disposed within the top rail proximate the third end. A left side rail and a right side rail are provided. A first shower door has a first roller extending upwardly from a first top edge of the first shower door. The first shower door also has a first bottom edge. A second shower door has a second roller extending upwardly from a second top edge of the second shower door. The second shower door also has a second bottom edge. The bottom rail is positioned atop the front wall of the bathing enclosure between the first outside wall and the second outside wall of the enclosure so as to abut the first outside wall. The lower tensioning mechanism abuts the second outside wall, in tension, so as to wedge the bottom rail between the first outside wall and the second outside wall. The left rail is positioned against the second outside wall and is secured to the bottom rail at the first end. The right rail is positioned against the first outside wall and is secured to the bottom rail at the second end. The top rail is positioned between the first outside wall and the second outside wall so as to abut the first outside wall. The upper tensioning abuts the second outside wall, in tension, so as to wedge the top rail between the first outside wall and the second outside wall. The left rail is secured to the top rail at the third end and the right rail is secured to the top rail at the fourth end. The first roller is rollably disposed within the first roller track and the first bottom edge is disposed within the first channel while the second roller is rollably disposed within the second roller track and the second bottom edge is disposed within the second channel. A first resilient bumper may be located on a lower surface of the bottom rail while a second resilient bumper may be located along a first outer surface of the left rail and a third resilient bumper may be located along a second outer surface of the right rail. The lower tensioning mechanism comprises a first ram advanced and retarded by a first ratcheting mechanism gearably mated to the lower ram via a first rack and pinion system while the upper tensioning mechanism comprises a second ram advanced and retarded by a second ratcheting mechanism gearably mated to the upper ram via a second rack and pinion system. The lower tensioning mechanism is disposed between the bathtub (or floor of the shower) and the first channel and second channel. The first roller track and second roller track are each disposed between the left rail and right rail and the upper tensioning mechanism.

Stated another way, the temporary shower door system of the present invention is comprised a frame that has a pair of horizontal legs joined by a pair of vertical legs such that a one or a pair of shower doors is either slidably or pivotally attached to one of the horizontal legs (both in the case of pivotal attachment) with the other horizontal leg sitting atop the bathing enclosure and each of the vertical legs abutting a respective one of the outer side walls and such that a pair of tensioning mechanisms is each attached to a respective one of the horizontal legs in order for each tensioning mechanism to engage one of the outside walls in order to wedge the frame between the pair of outside walls.

BRIEF DESCRIPTION OF THE DRAWINGS

Similar reference numerals refer to similar parts throughout the several views of the drawings.

DESCRIPTION OF THE PREFERRED EMBODIMENT

Figure 1:
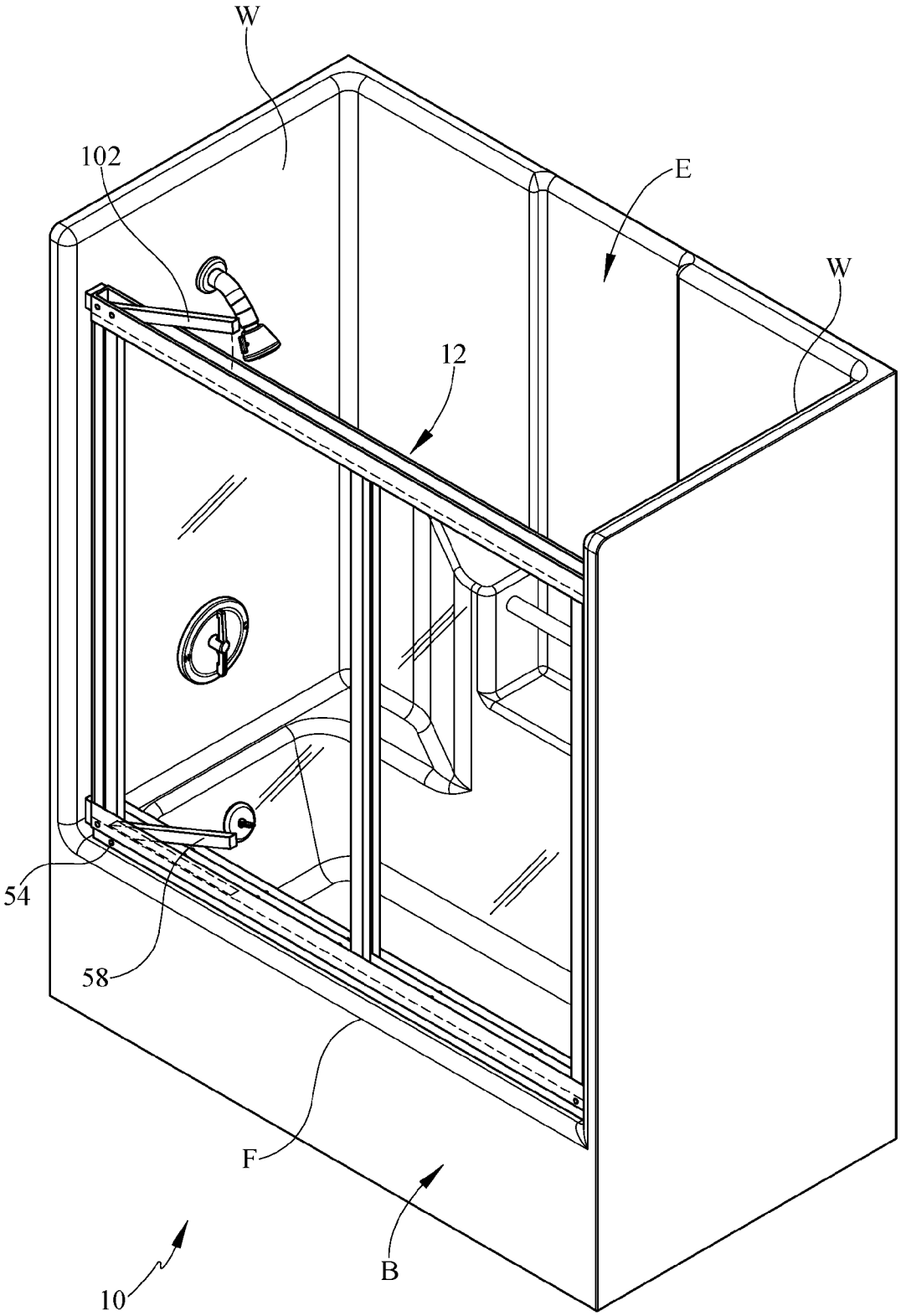
FIG. 1 is a perspective view of the temporary shower door system of the present invention installed within a bathing enclosure.
Figure 2:
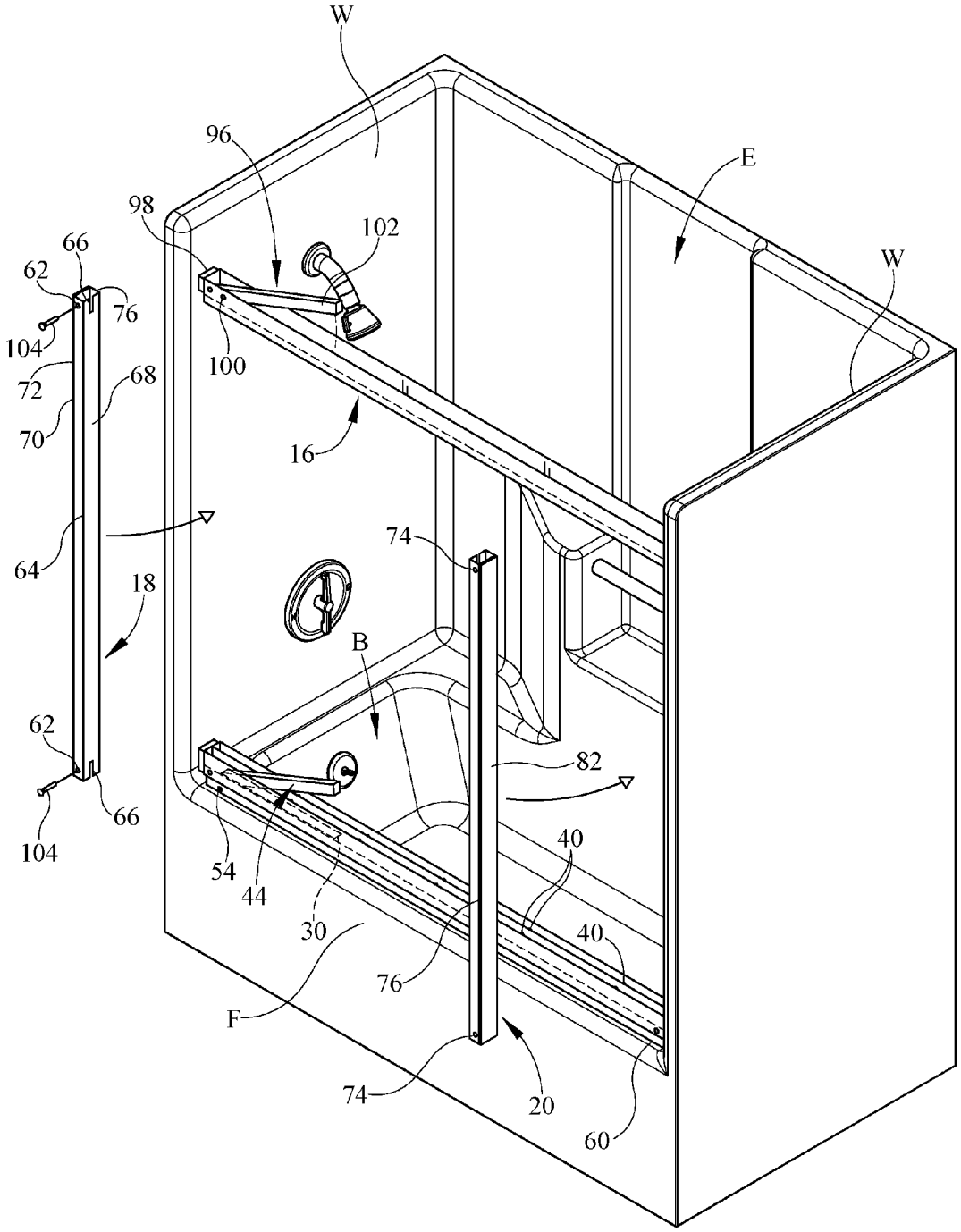
FIG. 2 is a perspective view of the temporary shower door system illustrating installation of the frame.
Figure 3:
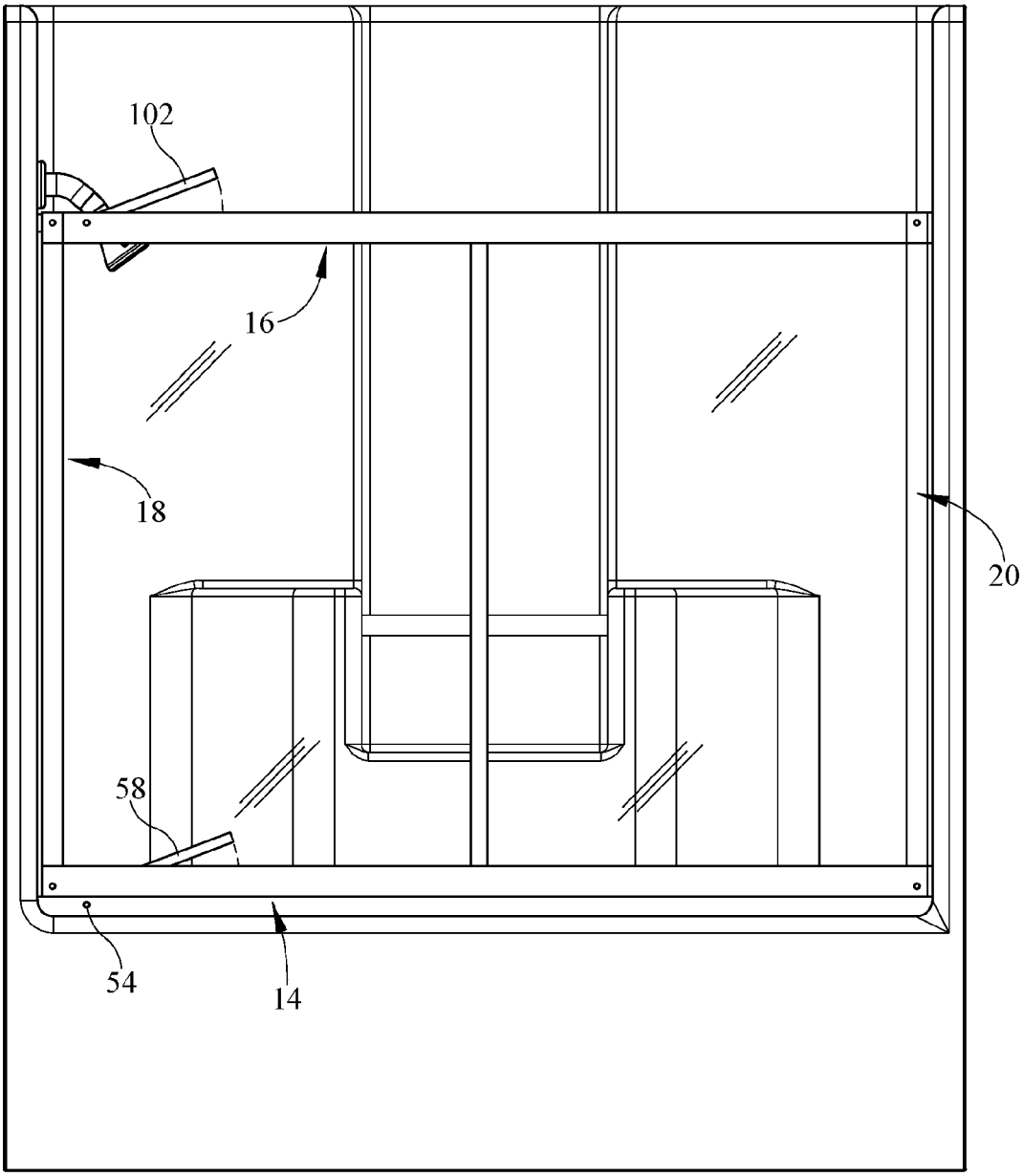
FIG. 3 is an elevation view of temporary shower door system.
Figure 4:
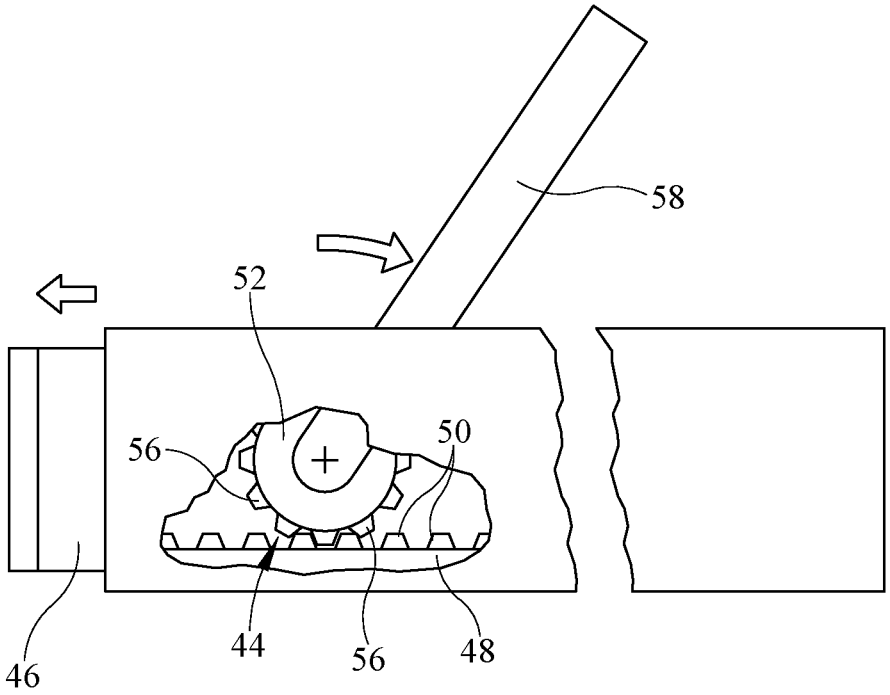
FIG. 4 is a close-up view of the tensioning mechanism used with the temporary shower door system.
Figure 5:
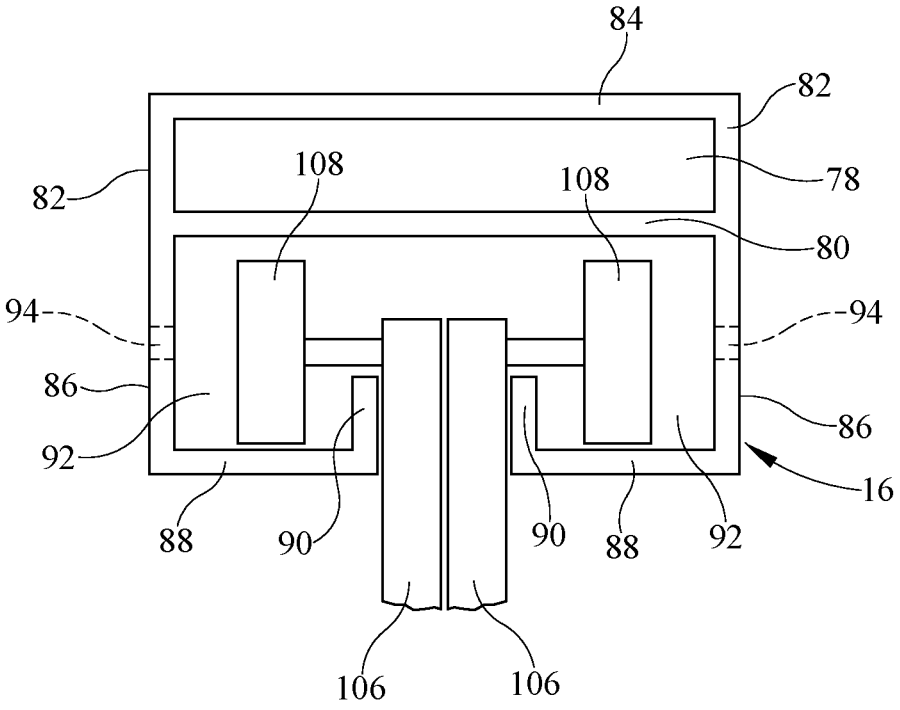
FIG. 5 is an end view of the top rail of the frame of the temporary shower door system.
Figure 6:
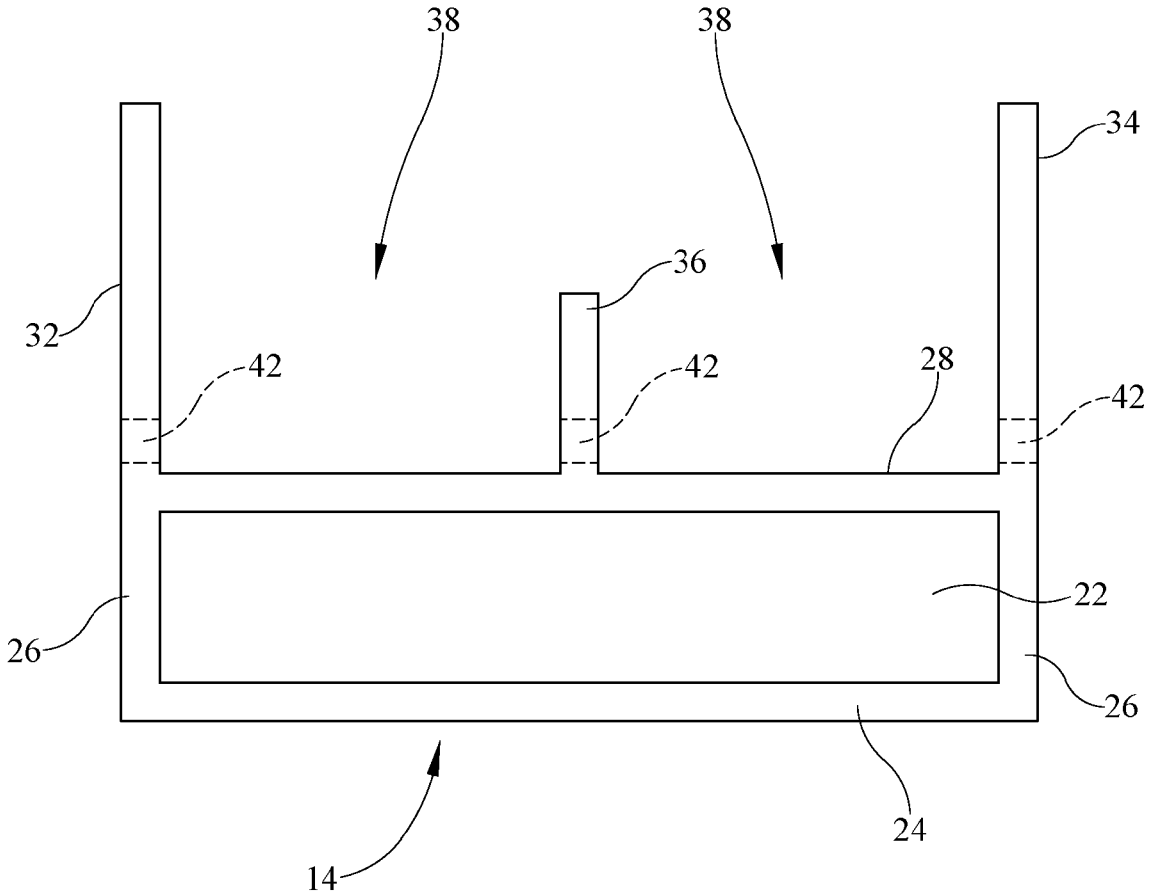
FIG. 6 is an end view of the bottom rail of the frame of the temporary shower door system.
Figure 7:
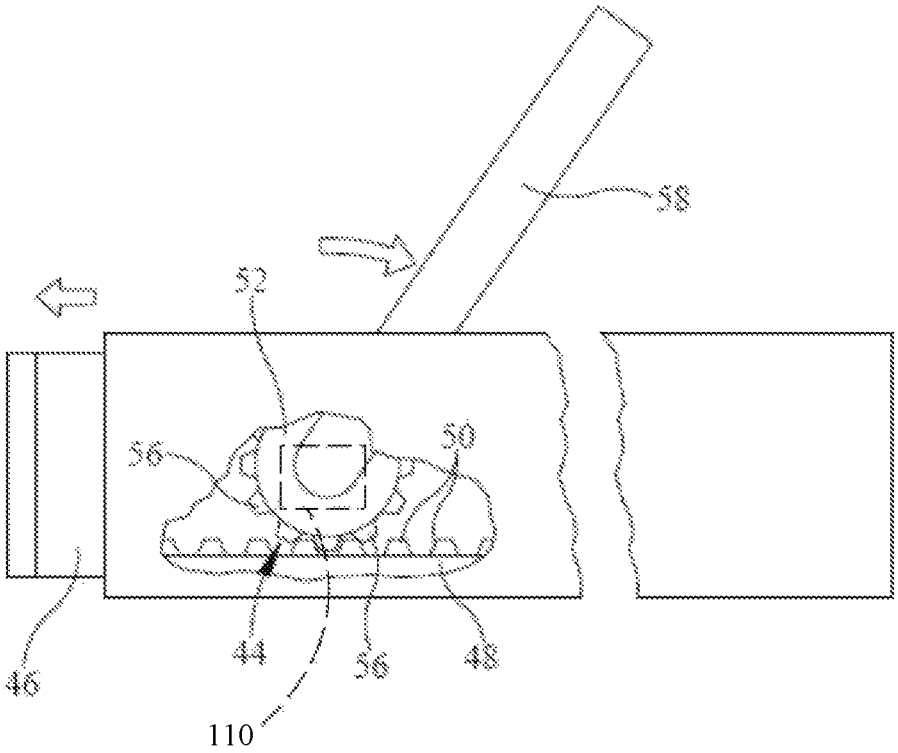
FIG. 7 is a close-up view of the tensioning mechanism and the lower lever including a ratcheting mechanism.

Referring now to the drawings, it is seen that the temporary shower door system of the present invention, generally denoted by reference numeral 10, is comprised of a frame 12 that has a bottom rail 14, a top rail 16, a left rail 18 and a right rail 20. As seen, the bottom rail 14 has a first mechanical compartment 22 that has base 24 and a pair of outer lower side walls 26 with a guide surface 28 forming the top of the mechanical compartment 22, the guide surface 28 having a lever opening 30 on one end thereof. Extending upwardly from the guide surface 28 is an outside upright 32, an inside upright 34, and a center upright 36 disposed between the outside upright 32 and the inside upright 34 so that a pair of channels 38 is formed. The outside upright 32 and the inside upright 34 may each be an extension of a respective one of the outer lower side walls 26. As seen a series of drain openings 40 are located along the length of the inside upright 32 and center upright 34. Corresponding opening pairs 42 are located proximate either end of the bottom rail 14 on the outside upright 32 and the inside upright 34, with a possible third corresponding opening located on the center upright 36 depending on whether the opening pairs 42 on the outside upright 32 and the inside upright 34 are above the top of the center upright 34 or not.

Located at one end of the bottom rail 14 is a lower tensioning mechanism 44, disposed within the first mechanical compartment 22. As seen, the lower tensioning mechanism 44 comprises a lower ram 46 that extends out of and retracts into the end of the bottom rail 14. As seen, located along a length of the lower ram 46 is a lower rail gear 48 having a first series of lower teeth 50 thereon. A lower rotary gear 52 is rotatably mounted within the first mechanical compartment 22 (such as to the outer lower side walls 26 of the first mechanical compartment 22 via a lower axle pin 54), the lower rotary gear 52 having a second series of lower teeth 56 thereon that gearably mesh with the first series of lower teeth 50 to form a basic rack and pinion gear system. A lower lever 58 controls rotation of the lower rotary gear 52 via a simple ratcheting mechanism 110 similar to the ratcheting mechanism found in a standard socket wrench, so that when the ratcheting mechanism is set for a first direction, pumping of the lower lever 58 causes the lower rotary gear 52 to turn in a first direction which causes the lower ram 46 to advance and when the ratcheting mechanism is set for a second direction, pumping of the lower lever 58 causes the lower rotary gear 52 to turn in an opposite second direction which causes the lower ram 46 to retard, the switching of the ratcheting mechanism between the first direction and the second direction via an appropriate switch (not illustrated).

A relatively soft bumper 60 may be located along the bottom of the bottom rail 14. The bumper 60 may be made from rubber, neoprene, closed cell foam, etc.

As seen, the left rail 18 is a generally elongate tubular member that has a pair of corresponding openings 62 located on the side surfaces 64 of the left rail 18, proximate either end thereof. A pair of notch pairs 66 is located on the inner surface 68 and outer surface 70 of the left rail 18, each notch 66 extending upwardly from a respective end of the left rail 16. A relatively soft bumper 72 may be located along the outer surface 70 of the left rail 18. The bumper 72 may be made from rubber, neoprene, closed cell foam, etc.

The right rail 20 is substantially similar to the left rail 18 and is generally elongate tubular member that has a pair of corresponding openings 74 located on the side surfaces 76, proximate either end thereof. The right rail 20 need not have the notches which the left rail 18 has, although for ease of manufacture and simplicity of installation, such notches can be present thereon, without loss of functionality. Another relatively soft bumper 72 may be located along the outer face of the left rail 20.

As seen, the top rail 16 has a second mechanical compartment 78 that has bottom wall 80, a pair of outer upper side walls 82, and a top wall 84. Extending downwardly from the bottom wall is a roller housing that has a pair of down walls 86 such that each down wall 86 is an extension of a respective one of the outer upper side walls 82, a roller floor 88 inwardly directed from each down wall 86 and an upwardly directed lip 90 located on the end of each roller floor 88 such that a pair of roller tracks 92 is formed. Corresponding opening pairs 94 are located proximate either end of the top rail 16 on each down wall 86.

Located at one end of the top rail 16 is an upper tensioning mechanism 96, disposed within the second mechanical compartment 78. The upper tensioning mechanism 96, which is substantially similar to the lower tensioning mechanism 44—so that the internal details are not separately illustrated—comprises an upper ram 98 that extends out of and retracts into the end of the top rail 16. Located along a length of the upper ram 98 is an upper rail gear having a first series of upper teeth thereon. An upper rotary gear is rotatably mounted within the second mechanical compartment 78 (such as to the outer upper side walls 82 of the second mechanical compartment 78 via an upper axle pin 100), the upper rotary gear having a second series of upper teeth thereon that gearably mesh with the first series of upper teeth to form a basic rack and pinion gear system. An upper lever 102 controls rotation of the upper rotary gear via a simple ratcheting mechanism 110 similar to the ratcheting mechanism found in a standard socket wrench, so that when the ratcheting mechanism is set for a first direction, pumping of the upper lever 102 which causes the upper rotary gear to rotate in one direction so as to cause the upper ram 98 to advance and when the ratcheting mechanism is set for a second direction, pumping of the upper lever 102 causes the upper rotary gear to turn in an opposite second direction which causes the upper ram 98 to retard, the switching of the ratcheting mechanism between the first direction and the second direction via an appropriate switch (not illustrated).

In order to use the temporary shower door system 10 of the present invention, the bottom rail 14 is positioned atop the front wall F of a bath tub B (this includes the floor in a shower only bathing enclosure) and is secured in place by tensioning the bottom rail 14 between the two side walls W of the tub enclosure E the non-lower-tensioning-mechanism end of the bottom rail abutting its side wall W. Such tensioning is accomplished via the lower tensioning mechanism 44 so that the ratcheting system of the lower tensioning mechanism 44 is set for lower ram outward advancement. The lower lever 58 is pumped so as to advance the lower ram 46 until the lower ram 46 engages its respective side wall W so as to securely wedge the bottom rail 14 in place between the two side walls W. The lower lever 58 is placed into its lower most position wherein its upper surface acts as a portion of the bottom of one of the channels 38. Thereafter, the left rail 18 is placed against the side wall W with which the lower ram 46 is engaged. The left rail 18 is fitted into the end of the bottom rail 14 so that the openings 62 of the left rail 18 align with the openings 42 on that end of the bottom rail 14. The notch pairs 66 located at the lower end of the left rail 18 straddle the lower ram 46. The bottom rail 14 and the left rail 18 are secured to each other by passing an appropriate pin or bolt 104 through the aligned opening sets 42 and 62. Thereafter, the right rail 20 is placed against the opposing side wall W. The right rail 20 is fitted into the end of the bottom rail 14 so that the openings 74 of the right rail 18 align with the openings 42 on that end of the bottom rail 14. The bottom rail 14 and the right rail 20 are secured to each other by passing an appropriate pin or bolt 104 through the aligned opening sets 42 and 74. Thereafter, doors 106 are secured to the top rail 16 by having the rollers 108 of each door 106 positioned within one of the roller tracks 92. The top rail 16 is then placed onto the ends of the left rail 18 and the right rail 20 so that the left rail 18 and the right rail 20 are each fitted into the top rail 16 and such that the non-upper-tensioning-mechanism end of the top rail 16 abuts one of the side walls W. During such placement, the bottoms of each door 106 are each positioned into one of the channels 38 of the bottom rail 14. Once so fitted, the top rail 16 and the left rail 18 are secured to each other by aligning the openings 62 of the left rail 18 and the openings 94 of the top rail 16 and passing an appropriate pin or bolt 104 through the aligned opening sets 62 and 94. The top rail 16 and the right rail 20 are secured to each other by aligning the openings 74 of the right rail 20 and the openings 94 of the top rail 16 and passing an appropriate pin or bolt 104 through the aligned opening sets 74 and 94. Finally, the top rail 16 is secured in place by tensioning the top rail 16 between the two side walls W of the tub enclosure E. Such tensioning is accomplished via the upper tensioning mechanism 96 so that the ratcheting system of the upper tensioning mechanism 96 is set for upper ram advancement. The upper lever 102 is pumped so as to advance the upper ram 98 until the upper ram 98 engages its respective side wall W so as to securely wedge the top rail 16 in place. The top rail 16 and the left rail are secured to each other. The temporary shower door system 10 is now ready for use so that each door 106 is slidable back and forth.

Removal of the temporary shower door system 10 is accomplished by reversing the process by untensioning the bottom rail 14 and the top rail 16, unbolting the various rails from each other, removing the doors 106 from the channels 38 and roller tracks 92, and unbolting the various rails 14, 16, 18, and 20 from each other and removing the various components. Of course, the temporary shower door system 10 can remain installed indefinitely in place, the temporary description of the system signifying the fact that no permanent alterations to the tub enclosure are needed, nor is the use of strong adhesives.

Of course, swinging doors can also be attached to the top rail and the bottom rail instead of sliding doors. As such, the doors are pivotally attached to the top rail and bottom rail proximate the ends thereof and the doors pivot thereabout. In such a configuration, a single door can be pivotally attached to the top rail and the bottom rail and a fixed panel attached to the top rail and the bottom rail on the other half of the frame or both panels can be pivotally attached.

While the invention has been particularly shown and described with reference to an embodiment thereof, it will be appreciated by those skilled in the art that various changes in form and detail may be made without departing from the spirit and scope of the invention.

I claim:

1. A barrier for temporary installation within a bathing enclosure having a front surface, the enclosure having a first outside wall and a second outside wall, the barrier comprising:

a bottom rail having a first end and a second end and a first channel and a parallel second channel;

a lower tensioning mechanism disposed within the bottom rail proximate the first end;

a top rail having a third end and a fourth end and a first roller track and a parallel second roller track;

an upper tensioning mechanism disposed within the top rail proximate the third end;

a left side rail;

a right side rail;

a first shower door, having a first roller extending upwardly from a first top edge of the first shower door, the first shower door also having a first bottom edge;

a second shower door, having a second roller extending upwardly from a second top edge of the second shower door, the second shower door also having a second bottom edge;

wherein the bottom rail is positioned atop the front surface between the first outside wall and the second outside wall so as to abut the first outside wall and the lower tensioning mechanism abutting the second outside wall in tension so as to wedge the bottom rail between the first outside wall and the second outside wall and such that the left side rail is positioned against the second outside wall and is secured to the bottom rail at the first end and the right side rail is positioned against the first outside wall and is secured to the bottom rail at the second end and the top rail is positioned between the first outside wall and the second outside wall so as to abut the first outside wall and the upper tensioning mechanism abutting the second outside wall in tension so as to wedge the top rail between the first outside wall and the second outside wall and such that the left side rail is secured to the top rail at the third end and the right side rail is secured to the top rail at the fourth end and such that the first roller is rollably disposed within the first roller track and the first bottom edge is disposed within the first channel and the second roller is rollably disposed within the second roller track and the second bottom edge is disposed within the second channel, and wherein the lower tensioning mechanism comprises a lower ram advanced and retarded by a first ratcheting mechanism gearably mated to the lower ram via a first rack and pinion system and the upper tensioning mechanism comprises an upper ram advanced and retarded by a second ratcheting mechanism gearably mated to the upper ram via a second rack and pinion system.

2. The barrier as in claim 1 further comprising a first resilient bumper located on a lower surface of the bottom rail.

3. The barrier as in claim 2 further comprising:

a second resilient bumper located along a first outer surface of the left side rail; and a third resilient bumper located along a second outer surface of the right side rail.

4. The barrier as in claim 1 wherein the lower tensioning mechanism is disposed between the front surface and the first channel, the lower tensioning mechanism further being disposed between the front surface and the second channel.

5. The barrier as in claim 4 wherein the first roller track and second roller track are each disposed between the left side rail and the right side rail and the upper tensioning mechanism.

6. A barrier for temporary installation within a bathing enclosure having a front surface, the enclosure having a pair of outside walls, the barrier comprising a frame having a pair of horizontal legs joined by a pair of vertical legs such that a shower door is attached to one of the horizontal legs with the other horizontal leg sitting atop the front surface and each of the vertical legs abutting a respective one of the outside walls and such that a pair of tensioning mechanisms is each attached to a respective one of the horizontal legs in order for each tensioning mechanism to engage one of the outside walls in tension in order to wedge the frame between the pair of outside walls, wherein the lower tensioning mechanism comprises a lower ram advanced and retarded by a first ratcheting mechanism gearably mated to the lower ram via a first rack and pinion system and the upper tensioning mechanism comprises an upper ram advanced and retarded by a second ratcheting mechanism gearably mated to the upper ram via a second rack and pinion system.

7. The barrier as in claim 6 wherein the shower door is slidably attached to one of the horizontal legs.

8. The barrier as in claim 6 further comprising a first resilient bumper located on a lower surface of one of the horizontal legs.

9. The barrier as in claim 8 further comprising a pair of second resilient bumpers each located along a first outer surface of one of the vertical legs.

* * * * *